United States Patent [19]

Nielsen

[11] 4,141,552

[45] Feb. 27, 1979

[54] TOY DRONE CAR GAME

[75] Inventor: Edwin A. Nielsen, Oceanside, N.Y.

[73] Assignee: Ideal Toy Corporation, Hollis, N.Y.

[21] Appl. No.: 824,668

[22] Filed: Aug. 15, 1977

Related U.S. Application Data

[63] Continuation-in-part of Ser. No. 747,442, Dec. 6, 1976, Pat. No. 4,078,798.

[51] Int. Cl.[2] ..... A63F 9/14; A63H 18/12

[52] U.S. Cl. ..... 273/86 B; 46/262

[58] Field of Search ..... 273/86 B; 46/251, 259, 46/262; 104/149, 150, 151, 60

[56] References Cited

U.S. PATENT DOCUMENTS

| | | | |
|---|---|---|---|
| 2,717,557 | 9/1955 | Seyffer | 46/259 X |
| 3,469,311 | 9/1969 | Ernst | 273/86 B X |
| 3,570,180 | 3/1971 | Oda | 46/259 |
| 3,813,812 | 6/1974 | Barlow et al. | 46/259 |

*Primary Examiner*—Anton O. Oechsle

*Attorney, Agent, or Firm*—Richard M. Rabkin

[57] ABSTRACT

A toy vehicle and toy vehicle game are disclosed in which a plurality of toy vehicles are provided that collect current from conductor strips in a slotless track and switch lanes when the current polarity is reversed. A toy drone car is used in the game which collects current from the strips associated with the other cars and it includes an electrical circuit which insures that current of only a predetermined desired polarity is supplied to the motor in the vehicle to propel the vehicle in a forward direction around the track. As a result the vehicle is driven about the track in a forward direction regardless of the polarity of current applied to the collector strips.

9 Claims, 7 Drawing Figures

10
12
14
16
18
20
22
24
26
28
30
32
A
B
C 22
42
43
44
45
47
49
50
52

TOY DRONE CAR GAME

This application is a continuation-in-part of U.S. patent application Ser. No. 747,442 filed Dec. 6, 1976, now U.S. Pat. No. 4,078,798, the disclosure of which is incorporated herein by reference.

The present invention relates to toy vehicles and toy vehicle games, and more particularly to a drone car driven along the track of the game by collecting current from electrical conductors in the track while other controllable vehicles are operated on the track.

In my earlier above noted patent application, a battery powered toy vehicle was disclosed for use as a drone car moving at constant speed on the track of a toy vehicle game in which other controllable vehicles were provided. The controllable vehicle's speed could be varied and their relative lane positions on the track could be changed by changing the polarity of the current supplied to those vehicles to enable them to pass each other and/or the drone car. In that case the drone car was driven at a relatively constant speed and its battery was continuously trickle charged from the track conductor strips as it moved along the track.

It is an object of the present invention to provide a drone vehicle, for use in a race game whose speed can vary.

Another object of the present invention is to provide a toy vehicle game in which a motor driven drone vehicle is adapted to receive current from the current supply tracks of two controllable toy vehicles and is driven thereby at a speed proportional to the highest voltage of proper polarity which it receives.

Another object of the present invention is to provide a top vehicle race game which includes a drone car or obstacle vehicle that is automatically operated at a speed proportional to at least one of the other vehicles in the game when such other vehicle is operated.

Yet another object of the present invention is to provide a toy vehicle and toy vehicle game of the character described which is relatively simple and inexpensive in construction.

A still further object of the present invention is to provide a toy vehicle and toy vehicle race game which is durable and reliable in use.

In accordance with an aspect of the present invention a toy vehicle is provided which is adapted to be used in a toy vehicle race game of the type having a track and a plurality of current supply strips in the track along the path of travel for the toy vehicles thereon. One such toy vehicle game is disclosed in U.S. patent application Ser. No. 747,441, filed Dec. 6, 1976, now abandoned and commonly assigned herewith. The disclosure of said U.S. patent application Ser. No. 747,441, is incorporated herein by reference, which disclosure is identical to the disclosure of U.S. Pat. No. 4,078,799 issued from a divisional patent application. In that type of game the track provides at least two lanes for toy vehicles, with power being supplied to the respective toy vehicles under the independent and separate control of the players so that each vehicle's speed of movement and its position along the track (i.e. its relative position in the respective lanes) can be independently controlled by the operators regardless of the lanes in which the vehicles are located. The toy vehicle of the present invention is used on this track to provide, according to one feature of the invention, a drone car for the game which provides an obstacle on the track, requiring the players to operate their controllable vehicles to steer around and pass the drone.

The drone includes a frame having an electric motor mounted therein for driving at least one drive wheel of the vehicle. Electrical current from the track is collected through current collectors which are operatively connected to the motor through a diode bridge circuit which supplies only current of the desired polarity to the motor so that the drone is always driven about the track in the forward direction. Preferably the vehicle includes a step down transmission ratio so that it will move at a slower speed than the fastest moving controllable vehicle on the track.

The above, and other objects, features and advantages of this invention will be apparent in the following detailed description of an illustrative embodiment thereof, which is to be read in connection with the accompanying drawings, wherein.

Figure 1:
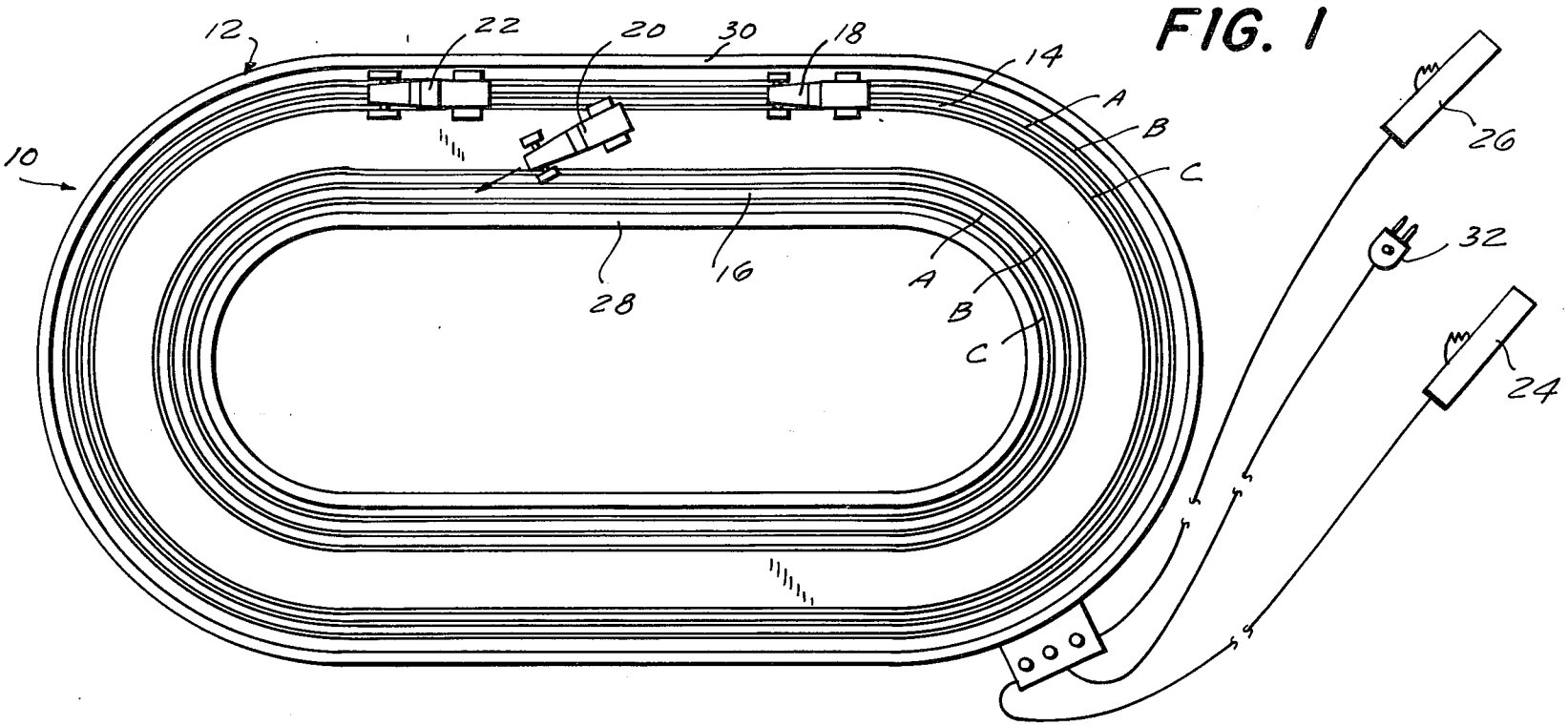
FIG. 1 is a plan view of a toy game within which the toy vehicle of the present invention is utilized.
Figure 2:
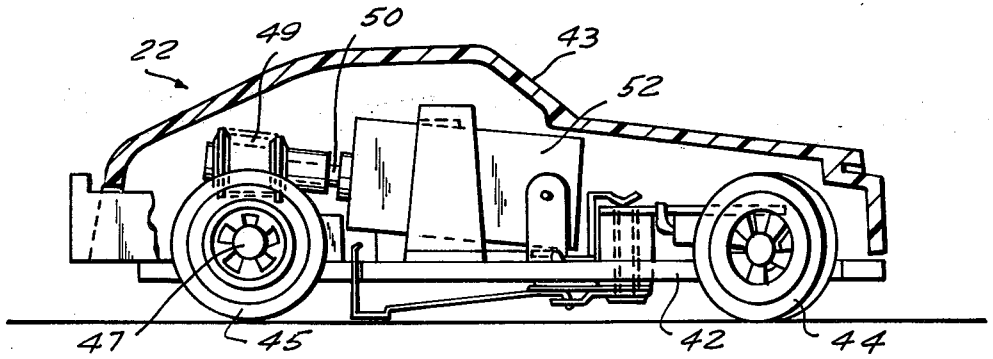
FIG. 2 is a longitudinal sectional view of the toy vehicle constructed in accordance with the present invention.

Referring now to the drawings in detail, and initially to FIG. 1 thereof, it will be seen that a game 10, in which the toy vehicle of the present invention is adapted to be utilized includes a track 12 defining two lanes 14, 16 along which operator controlled toy vehicles 18, 20 are adapted to move and pass each other. In accordance with the invention a drone car 22 is placed on the track to move along the track at a speed which is slower than that of the speed of at least one of the controllable cars thereby presenting an obstacle to the vehicles 18, 20 which must be passed as the vehicles move around the track.

Figure 5:
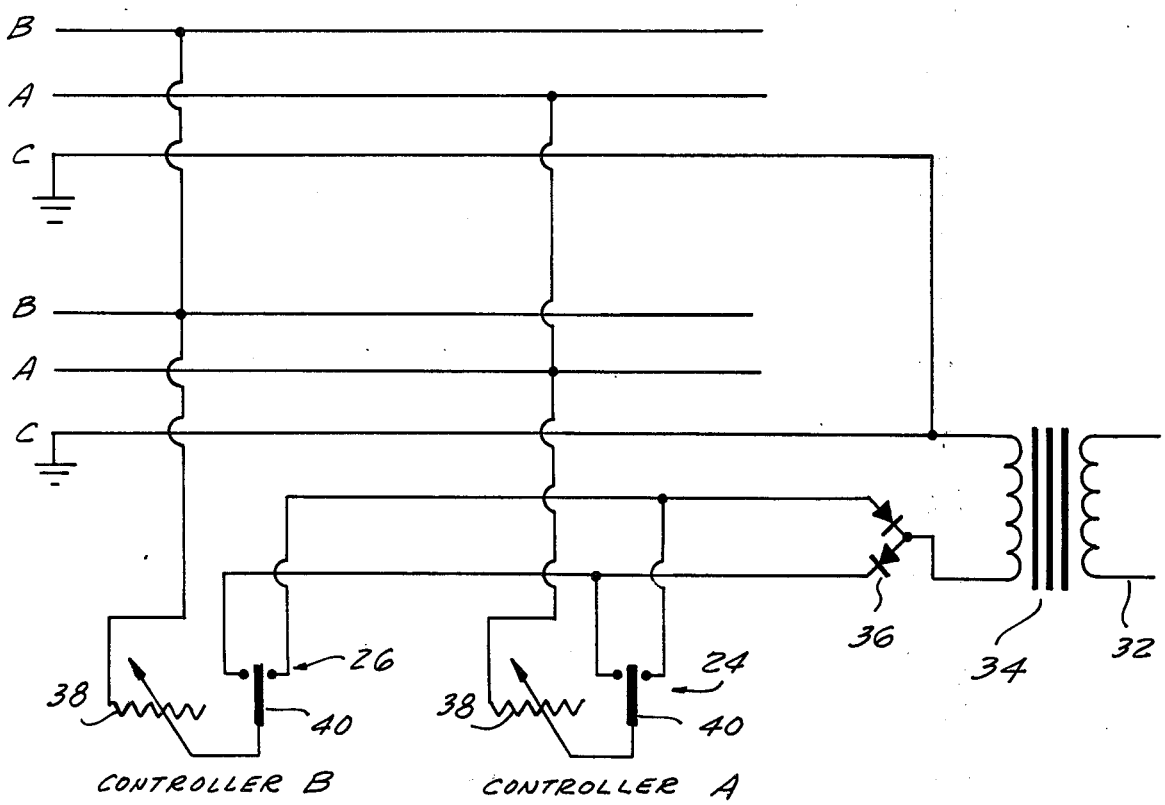
FIG. 5 is a circuit diagram showing the power supply and control system used to supply current to the track conductors.

The game 10 is described in detail in the above U.S. patent application Ser. No. 747,441 filed Dec. 6, 1976 and reference is made to said application for a detailed description of the operation and structure thereof. Basically the game includes three conductive strips A, B, C embedded in each lane 14, 16 substantially flush with the track surface, with corresponding strips in each lane (i.e. strips A, strips B and strips C) being electrically connected to each other, and with strips C being connected to electrical ground, as shown in FIG. 5. Strips A and B are respectively controlled by individual controllers 24, 26 operated by the players to control current supply thereto and to also control the polarity of current supplied to the toy vehicles. The latter are provided with current collectors on their lower surfaces respectively associated with the strips A or B so that, for example, vehicle 18 collects current only from the strips A under the control of controller 24 and vehicle 20 collects current only from the strips B. The drive arrangement of the vehicles 18, 20 is such that one or the other of their rear drive wheels is driven in accordance with the polarity of the current supplied to its associated contact strip so that the toy vehicle is driven against either the inner wall 28 or the outer wall 30 of track 12 and will switch lanes as a result of a change in the selection of which rear drive wheel is powered. In this manner the operators have full control over the speed of movement of toy vehicles 18, 20 and lanes in which the vehicles will move. This will enable the operators to turn their vehicles 18, 20 out of a lane to pass drone car 22 or to pass each other.

The control system 30 for the toy vehicle game is shown schematically in FIG. 5 and includes, in addition to the respective controllers 24, a plug 32 by which the system can be connected to an electrical AC power source and a transformer 34. Power is supplied from transformer 34 through a half-wave rectifier 36 including two diodes connected as shown to separately supply current to the controllers 24, 26. Each controller is provided as a hand held unit and includes a variable resistor 38, operated as a trigger on the unit, as well as a single pole double throw switch 40. Current from controller 24 is supplied through its variable resistor 38 to the contact strips A and current from the controller 26 is supplied through its variable resistor to the contact strips B. The variable resistors may be of any convenient construction to permit the operators to vary the current supplied to their respective contact strips, and thus their respective vehicles, in order to vary the speed of the vehicles.

The polarity of the current supplied to the toy vehicles is separately and independently controlled by switches 40 so that the polarity of current supplied to the motors of the respective vehicles, as controlled by the respective controllers, will vary in accordance with the position in which the switches 40 are placed. By this arrangement each player, using his controller 26 or 24, can control the speed of his vehicle along the track 12 and he can also variably position his vehicle along the track simply by changing the polarity of current supplied to the vehicle. As described above the polarity of the current supplied to the motor of the respective toy vehicles will determine which of the two rear drive wheels is powered, and this will determine which lane the vehicle will be driven in. In this embodiment of the invention, the motors in the toy vehicles 18, 20 and the current supply circuit of FIG. 5 are arranged such that the left drive wheel of the vehicles will be driven when positive polarity current is supplied thereto and their right drive wheels will be driven when negative polarity current is supplied thereto. For example, lowermost diode 36 is adapted to conduct during positive half-cycles of the alternating current and uppermost diode 36 is adapted to conduct during negative half-cycles of the alternating current. When a switch 40 of one of the controllers engages a left-hand contact, positive current flows from transformer 34, lowermost diode 36, switch 40 and variable resistor 38 to a corresponding track (A or B), and thence through the motor of the respective vehicle to track C. If the switch 40 engages a right-hand contact, then negative current flows from transformer 34, uppermost diode 36, switch 40 and variable resistor 38 to the corresponding track (A or B), and thence through the motor of the respective vehicle to track C.

As illustrated in FIG. 1, when it is desired to switch a vehicle from the outer lane to the inner lane, as shown with vehicle 20, the polarity of current supplied to the vehicle is selected to drive the outer or right wheel of the vehicle thereby moving the vehicle leftwardly into the inner lane. Likewise, when it is desired to move the vehicle outwardly the inner or left wheel of the vehicle is driven, by properly selecting the polarity of current supplied to the motor of the vehicle, so that the vehicle will move toward the right and into the outer lane. Thus the operators have complete control over both the speed of the vehicle and the lane in which the vehicle will move.

In the illustrative embodiment of the invention, when a drone car 22 is utilized, an obstacle is provided in the outer lane of the track which the players must pass in order to continue moving along the track. This enhances the play value of the game as all players will have to pass the drone car during the game at some stage of operation of the game, and this introduces a further variable factor into the game requiring an additional degree of skill and vehicle control in order to win the "race".

Figure 3:
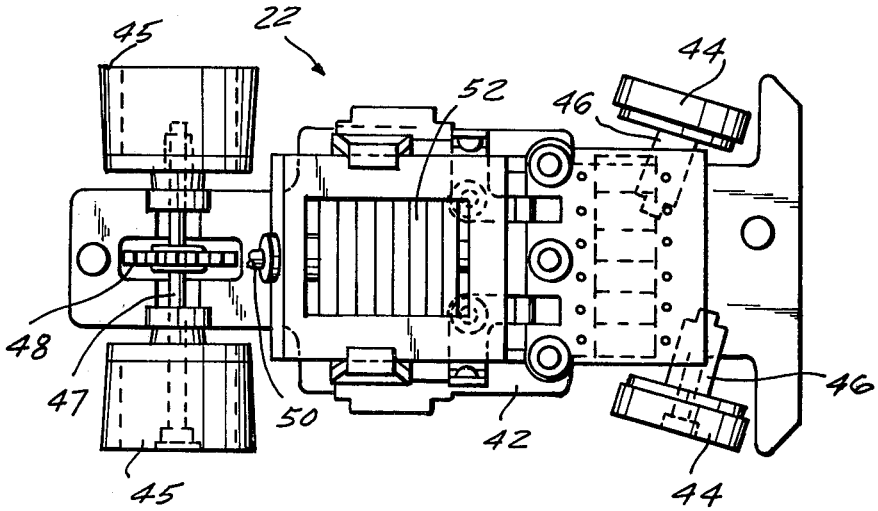
FIG. 3 is a plan view, with the body removed, of the toy vehicle illustrated in FIG. 2.
Figure 4:
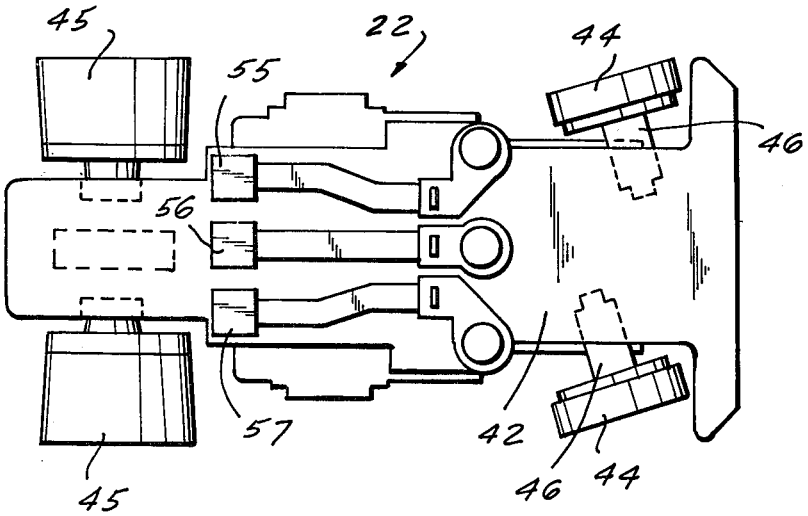
FIG. 4 is a bottom view of the toy vehicle.

Drone car 22 includes a frame 42, plastic body 43, and a pair of front and rear drive wheels 44, 45 respectively. The front wheels are preferably mounted in a slight angular relation to the longitudinal axis of the body so that the vehicle will always be driven toward and against one of the side walls of the track. Thus, as illustrated in FIGS. 3 and 4, the frame 42 has front wheel mounts 46 which are formed at angles to the longitudinal axis of frame 42, with wheels 44 being rotatably mounted thereon, so that wheels 44 are canted slightly to the right so the vehicle will stay in the outer lane of the track. If the front wheels are instead canted to the left the vehicle will stay in the inner lane of the track. Alternately the front wheels can be aligned straight on the frame. In that case, because of the effects of centrifugal force the drone car will normally move in the outer lane against outer wall 30, even if it is initially placed in the inner lane 16, because as the vehicle passes around a turn in the track it will be thrown by centrifugal force into the outer lane against outer wall 30.

Figure 6:
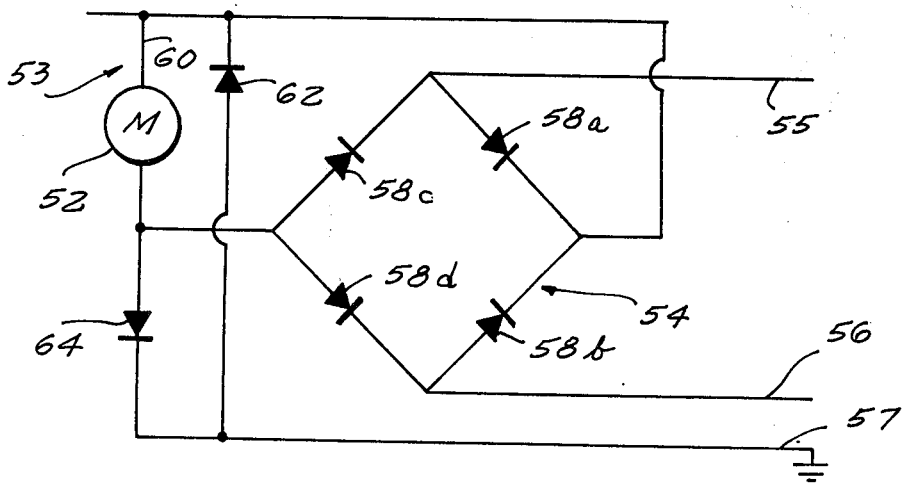
FIG. 6 is a circuit diagram of the diode bridge arrangement used to supply current of only the desired polarity to the motor of the drone car.

The rear drive wheels 45 are fixed on a rear drive shaft 47 which has a centrally located spur gear 48 rigidly secured thereto. This spur gear is driven through a worm gear 49 mounted on the output shaft 50 of an electric motor 52 mounted on frame 42. Current is supplied to the motor 52 from the contact strips on the track through a current control circuit 53 (FIG. 6), which includes a diode bridge 54, and a plurality of collector strips 55, 56, 57 mounted on the lower surface of frame 42 of the vehicle. These collector strips are formed of flexible metallic material and are removably mounted on the bottom of the frame 42 in any convenient manner. The collector strip 57 is located to contact strips C, i.e. the strips of the track connected to the ground, while contact strips 55, 56 are positioned to contact strips A and B, respectively and continuously pick up current from the track.

Collectors 55, 56 are electrically connected to the diode bridge 54 to supply current to the bridge. Since it is necessary to supply current to the motor 52 of only the polarity which will drive vehicle 22 in the forward direction, the diodes 58 of bridge 54 are arranged to permit current flow to only one side of motor 52. Thus the collectors can collect current from each of the strips A, B and C to supply current of proper polarity to motor 52. That is, if the polarity of the current applied to collectors 55 and 56 both are positive, then such positive current appears as current positive half-cycles. Hence, positive current flows from collector 55, through diode 58*a*, lead 60, motor 52 and diode 64 to collector 57. Also, positive current flows from collector 56, through diode 58*b*, lead 60, motor 52 and diode 64 to collector 57. Conversely, if the polarity of the current applied to collectors 55 and 56 both are negative, as when vehicles 18 and 20 both are in the inner lane, then such negative currents appear as concurrent negative half-cycles. Nevertheless, current continues to flow through motor 52 in the same direction as when the currents are positive. That is, current flows from collector 57, through diode 62, motor 52 and both diodes 58*c* and 58*d* to collectors 55 and 56, respectively.

Since it is normally desirable for the shiftable vehicles 18, 20 to be operating on the outermost track of the game, except during passing on the inner lane, the motors of the shiftable vehicles normally receive current of the polarity used to keep the shiftable vehicles 18, 20 in the outer lane. Thus the diodes 58 are arranged to permit only current of that polarity to pass to the motor. When both shiftable vehicles 18 and 20 are in the outer lane and supplied with current of the same polarity the motor 52 will receive only half wave voltage through rectifier 36 and thus will be driven from the contact strip having the highest voltage. On the other hand, if one steerable vehicle is in the outer lane and one is in the inner lane then the drone car will receive full wave voltage through rectifier 36 and the bridge of FIG. 6. That is, if voltage in contact strip A is positive and voltage in contact strip B is negative then, during the positive half-cycle, current flows from collector 55, through diode 58*a*, lead 60, motor 52 and diode 58*d* to collector 56; while during the next negative half-cycle, current flows from collector 56, through diode 58*b*, lead 60, motor 52 and diode 58*c* to collector 55. As a result of receiving full wave voltage, the drone car's speed will increase in this embodiment, when one of the shiftable vehicles is moved to the inner lane to pass.

In those instances where both shiftable vehicles 18, 20 are operated to shift them into the inner lane, so that the polarity of current in both strips A and B is opposite to that permitted by diodes 58 to pass to motor 52, the motor will continue to drive vehicle 22 and it will receive half wave voltage as diodes 62, 64 will permit current to pass from ground conductor 57 through diode 62 to motor 42 and then to bridge 54. Thus, regardless of the combination of polarities in conductor strips A and B (i.e. both positive, both negative, a one positive and one negative) the drone will always move in the forward direction under the influence of the conductor strip having the highest voltage of the proper polarity.

Preferably the gear transmission 48, 49 in vehicle 22 is selected to have a gear ratio such that the maximum speed of vehicle 22 will be less than the speed of the vehicle associated with the conductor strip supplying current to the drone. That is, the gear ratio is such that the maximum speed of the drone will be proportional to the maximum speed of the controllable vehicle. At present, it is believed that a seventy percent (70%) ratio is desirable. This is important, in addition, since when one vehicle is moved out of the outer lane to the inner lane and drone 22 receives full wave voltage its speed will increase and the gear reduction ratio will insure that the controllable vehicle can speed up fast enough to pass the drone.

Figure 7:
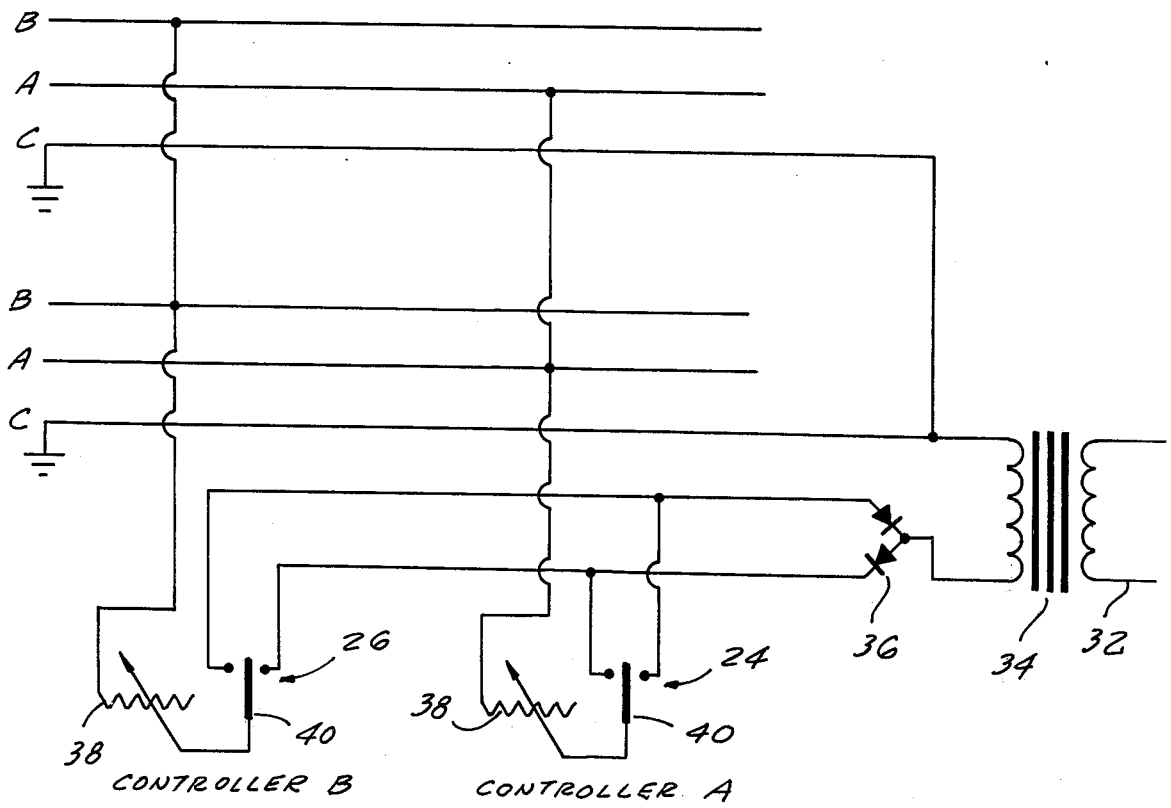
FIG. 7 is another circuit diagram showing a modified power supply and control system for use with the present invention.

In order to avoid increasing the speed of the drone car when one of the controllable vehicles is operated to pass the drone car, the control circuit for supplying current to the controllable vehicles 18, 20, can be modified, as shown in FIG. 7. In this embodiment of the invention, the power supply from the half wave rectifier 36 to the controller B for vehicle 20 is reversed, as is the drive motor in the vehicle itself, with the result that vehicle 20 will remain in the outer lane and drive in a forward direction when negative polarity current is supplied to its motor while vehicle 18 controlled by controller 24 will remain in the outer lane when positive current is supplied to its motor. In this manner, in the typical operation of the game, with both vehicles 18 and 20 in the outer lane, positive polarity current will be present in the collector strips A while negative polarity current will be present in the collector strips B. Thus the motor in the drone car (whose control circuit remains the same as in FIG. 6) receives full wave current from the tracks A and B through the half wave rectifier 36, in the same manner as described above with respect to the embodiment of FIG. 5 when one car is on the inner lane and one is in the outer lane. That is, the positive phase of the A.C. current flows through line 55 to the bridge 54 (through diode 58*a*) and then to the motor 52 through the lead 60, while the negative phase of the A.C. current, which is 180° out of phase from the positive phase, flows through the ground collector 57 to diode 62 and motor 52. Thus, with the circuit of FIG. 7, when both controllable vehicles 18 and 20 are in the outer lane, drone vehicle 22 will be driven at its maximum speed, dependent upon the speed at which the controllable vehicles are driven.

With this embodiment of the invention when one of the toy vehicles is switched to move to the inner lane in order to pass the drone car, then both vehicles in the inner and outer lane will have the same polarity current supplied to its motor. For example, when the vehicle 20 is moved to the inner lane, the current supplied thereto is switched from negative to positive, so that both vehicle 18 and 20 receive positive polarity current. As a result the vehicle motor 52 receives only positive half-wave current from the rectifier 36, and will slow down somewhat and move at a speed which is proportional to the speed of the fastest moving of the two vehicles 18 and 20. On the other hand, if vehicle 18 were moved to the inner lane, so that the current supplied to it was switched from positive to negative, with both vehicles 18 and 20 thus receiving negative polarity current, then again the motor of the drone car receives only half-wave current, and again moves only at a speed which is proportional to the speed of the fastest moving of the two vehicles. Thus again the drone car will slow down slightly while still presenting an obstacle in the outer lane which must be passed by the controllable toy vehicles. This facilitates passage of the drone car by the controllable toy vehicles.

By the above described arrangement the drone car will continuously operate on track 12 wherever one of the controllable vehicles 18, 20 is operated. Its speed will always be slower than the speed of the fastest car moving on the track and as it moves along the track, will vary in an unpredictable manner as the players vary the position and speed of their respective controllable vehicles, yet it will always move slower than those vehicles' maximum speed to provide an obstacle on the track which must be passed.

Accordingly it is seen that a relatively simply covehicle and toy vehicle game is provided in which a drone vehicle moves along the track at an unpredictable relatively slow speed while being driven by current supplied from strips located in the track.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy vehicle game comprising a guide track defining a pair of lanes along which two vehicles may move in side by side relation, means in said track in each of said lanes for separately supplying varying current flow of reversible polarity to at least two separate vehicles on said track, said means including a pair of laterally spaced current supply contact strips and a ground strip in each of said track lanes with the strips being in the same relative position in each lane, each of said current supply strips being electrically connected to a corresponding strip in the other lane, operator operable control means connected to said current supply strips for enabling the operator to separately supply current of reversible polarity and varying value thereto, and a drone vehicle for use on said track including a body, means for driving said body along said track including an electric motor, means in said drone vehicle respectively associated with the current supply strips and ground strip in a track lane for simultaneously collecting current from said current supply strips and means connected between said respective current collecting means and said motor for continuously supplying current of only a predetermined polarity to said motor from said strips in the track regardless of the polarity of current in the current supply strips.

2. A toy vehicle as defined in claim 1 wherein said vehicle includes a drive transmission and said means for supplying current of a predetermined polarity to said motor includes a pair of oppositely arranged diodes respectively connected between the current collector means associated with said ground strip and opposite sides of said motor.

3. A toy vehicle game as defined in claim 1 wherein said means for supplying current of a predetermined polarity to said motor includes a diode bridge connected between the motor and the current collecting means associated with said current supply strips.

4. A toy vehicle game as defined in claim 1 wherein said means for supplying current to the motor includes a pair of oppositely arranged diodes connected between said contact means and opposite sides of said motor.

5. The game as defined in claim 1 wherein said means for supplying varying current includes a power supply comprising a half-wave rectifier adapted to be connected to a source of alternating current and connected to said operator operable control means, said control means including means for selectively supplying the positive or negative half cycles of the alternating current to its associated current supply strip and means for varying the magnitude of said supplied positive and negative half cycles.

6. The game as defined in claim 5 wherein said means for continuously supplying current comprises means for supplying full wave rectified voltage from said strips when said control means are operated to separately supply positive half-wave rectified voltage and negative half-wave rectified voltage to their respective supply strips.

7. A toy vehicle game comprising a guide track defining a pair of lanes along which two vehicles may move in side by side relation, a pair of controllable toy vehicles each of which includes an electric motor and means for steering the vehicle into one or the other of said lanes in accordance with the polarity of current supplied thereto while continuously driving the vehicle in a forward direction; means in said track in each of said lanes respectively associated with said controllable vehicles for separately and independently supplying current of variable polarity and value to said controllable toy vehicles and a non-steerable drone vehicle for use on said track including a body, an electric motor and transmission for driving the drone vehicle in a forward direction; means in said drone vehicle for simultaneously collecting current from said respective current supply means for the controllable vehicles and means connected between the respective current collecting means on the drone vehicle and the drone vehicle's motor for supplying current of only a predetermined polarity to said motor at a value which is proportional to the value of the current supplied to at least one of the controllable vehicles.

8. A toy vehicle game as defined in claim 7 wherein said means for supplying varying current includes a half wave rectifier adapted to be connected to a source of alternating current; said means for supplying current of only a predetermined polarity to said motor comprising means for supplying full-wave rectified voltage to said motor when the currents supplied to the respective controllable toy vehicles are of different polarities and half-wave rectified voltage when the currents supplied to the respective controllable toy vehicles are of the same polarity.

9. A toy vehicle as defined in claim 7 wherein said means for supplying varying current includes a half-wave rectifier adapted to be connected to a source of alternating current; said means for supplying current of only a predetermined polarity to said motor comprising means for supplying half-wave rectified voltage to said motor when the currents supplied to the respective controllable toy vehicles are of different polarities and full-wave rectified voltage when the currents supplied to the respective controllable toy vehicles are of the same polarity.

* * * * *